US005139003A

United States Patent [19]

Ohhashi et al.

[11] Patent Number: 5,139,003

[45] Date of Patent: Aug. 18, 1992

[54] DISTRIBUTOR ASSEMBLY FOR AN INTERNAL COMBUSTION ENGINE

[75] Inventors: Yutaka Ohhashi; Koichi Okamura; Haruyuki Matsuo, all of Himeji, Japan

[73] Assignee: Mitsubishi Denki Kabushiki Kaisha, Tokyo, Japan

[21] Appl. No.: 764,875

[22] Filed: Sep. 24, 1991

[30] Foreign Application Priority Data

| | | | |
|---|---|---|---|
| Sep. 28, 1990 | [JP] | Japan | 2-101056 |
| Sep. 28, 1990 | [JP] | Japan | 2-101057 |
| Sep. 28, 1990 | [JP] | Japan | 2-101058 |
| Sep. 28, 1990 | [JP] | Japan | 2-101059 |
| Sep. 28, 1990 | [JP] | Japan | 2-101060 |
| Sep. 28, 1990 | [JP] | Japan | 2-101061 |
| Sep. 28, 1990 | [JP] | Japan | 2-101062 |

[51] Int. Cl.[5] ..... F02P 11/00

[52] U.S. Cl. ..... 123/635

[58] Field of Search ..... 123/635, 647, 650, 634, 123/143 C, 146.5 A, 146.5 R, 595, 605

[56] References Cited

U.S. PATENT DOCUMENTS

| | | | |
|---|---|---|---|
| 1,277,348 | 9/1918 | Aalborg | 123/635 |
| 1,317,357 | 9/1919 | Dorsey | 123/635 |
| 1,332,758 | 3/1920 | Rosorat | 123/635 |
| 1,473,585 | 11/1923 | Patterson | 123/635 |
| 1,484,658 | 2/1924 | Lauron | 123/635 |
| 1,783,343 | 12/1930 | Reis | 123/635 |
| 2,662,105 | 12/1953 | Bales | 123/635 |
| 2,885,458 | 5/1959 | Nause | 123/635 |
| 3,888,225 | 6/1975 | Boyer et al. | 123/635 |
| 4,907,563 | 3/1990 | Kodama | 123/635 |
| 4,960,099 | 10/1990 | Shimada et al. | 123/647 |
| 4,979,486 | 12/1990 | Shimada et al. | 123/635 |
| 5,000,624 | 10/1991 | Bruning et al. | 123/635 |
| 5,036,827 | 8/1991 | Shimada et al. | 123/634 |

*Primary Examiner*—Raymond A. Nelli

*Attorney, Agent, or Firm*—Sughrue, Mion, Zinn, Macpeak and Seas

[57] ABSTRACT

A distributor for an internal combustion engine comprising a base plate (20), a resin-molded ignition coil unit (21) and a resin-molded control unit (30) in a stacked relationship with their side circumferential surfaces exposed to define a portion of an outer surface of the distributor. A distributor cap (2), a cover (10) for covering the control unit are fastened to the base by a screw (32) extending through these components, and the ignition coil unit is attached to the base through a screw (24) extending through a bushing (23). The resin-molded ignition coil unit (21) may comprise an L-shaped external-connection connector (28, 37) integrally formed on the exposed side surface. The electrical connection between the ignition coil and the control unit may be established by a plug-in type connector (38, 39).

9 Claims, 5 Drawing Sheets

DISTRIBUTOR ASSEMBLY FOR AN INTERNAL COMBUSTION ENGINE

BACKGROUND OF THE INVENTION

This invention relates to a distributor assembly for an internal combustion engine and, more particularly, to a distributor assembly in which a current flowing through a primary coil of an ignition coil is switched on and off by a primary current switching means of a control unit.

FIG. 6 is a sectional side view illustrating one example of a conventional distributor assembly for an internal combustion engine, in which reference numeral 1 designates a housing made of aluminum, 2 is a cap which has a plurality of circumferential electrodes 3 to be connected to spark plugs (not shown) of an internal combustion engine (not shown) and which covers an opening of the housing 1, 4 is an ignition coil disposed within the housing 1 and has primary and secondary coil (not shown) and an iron core (see FIG. 4). Reference numeral 5 designates a rotary shaft rotatably supported by the housing 1 and adapted to be connected to an engine crankshaft (not shown) for synchronous rotation therewith, 6 is a signal disc plate mounted to the rotary shaft 5 by means of a blank 7, 8 is a control unit mounted to the housing 1 and allows the rotary shaft 5 to extend therethrough. Although not every components are illustrated, the control unit 8 comprises a crankshaft angle sensor 12 which detects crankshaft rotational angle in relation to the signal disc plate 6 to output a crankshaft rotational angle signal to a control computer (not shown), a primary current switching means which is a power transistor for switching the primary coil current of the ignition coil 4 in response to the signal from the control computer (not shown) and a control circuit for controlling the operation of the power transistor. Reference numeral 9 is a rotor securely mounted to the blank 7 for rotation therewith for distributing a secondary high voltage output from the ignition coil 4 to the circumferential electrodes 3 in synchronization with the rotation of the engine crankshaft, 10 is a cover which is an integral combination of a resin layer for preventing voltage leakage from the high-tension distribution region and a shield for suppressing noise generated by spark discharge in the high-tension distribution region, 11 is a seal member disposed between the cap 2 and the housing 1. In order to fixedly support the ignition coil 4 in the housing 1, a support plate 16 extending over a substantial portion of the top surface of the ignition coil 4 is securely mounted to the housing 1 by means of screws 17.

FIG. 7 is a plan view o the conventional distributor assembly illustrated in FIG. 6 but with the cap 2, the rotor 9 and the cover 10 removed. Reference numeral 13 designates a control unit connector integrally molded on the control unit 8 for transmitting a signal from the control computer to the control circuit and for supplying drive voltages to the power transistor and the crankshaft angle sensor unit 12, 14 is an ignition coil connector mounted to the housing 1 through a seal 19, and 15 are exposed terminals for connecting the primary coil of the ignition coil 4 to an external power source (not shown).

When the rotary shaft 5 is rotated as the engine crankshaft rotates, the signal disc plate 6 is also rotated to intermittently interrupt the light beam in the crankshaft angle sensor 12, upon which the crankshaft angle sensor 12 provides to the control computer an output signal indicative of the crankshaft rotational speed and position in response to the frequency of the intermittent light beam. The power transistor switches on and off the primary current of the ignition coil 4 in accordance with the signal from the control computer so that the secondary voltage is generated in the ignition coil 4 at the ignition timing. This secondary voltage is sequentially distributed to the circumferential electrode 3 as the distributor rotor 9 rotates, so that the spark plugs of the engine are sequentially ignited to keep the engine running.

In the conventional distributor assembly as above described, in order to protect the ignition coil 4 and the control unit 8 from dust and moisture, they are placed within the relatively large and heavy housing 1. However, since the housing is heavy and large in radial dimension, the distributor assembly is inevitably large and heavy. Also, since the housing 1 is made of aluminum, a large potential difference may be generated between the electrically conductive housing and the ignition coil 4 and a discharge spark may generate therebetween.

Also, since the ignition coil connector 14 is an individual member mounted to the housing 1 and the external source connector 15 is exposed to the exterior of the distributor housing 1, number of the parts is relatively large resulting in difficult assembly and poor resistance to moisture and the exposed wire connection. Also, the radially extending connectors 14 and 15 project from the housing 1 for a relatively large distance, thus increasing the overall radial dimension of the distributor assembly.

Further, since the ignition coil 4 is supported in the housing 1 by means of the support plate 16 and the screws 17, the number of components is relatively large, the assembled distributor is heavy and relatively expensive.

SUMMARY OF THE INVENTION

Accordingly, one object of the present invention is to provide a distributor assembly for an internal combustion engine which is compact and light weight.

Another object of the present invention is to provide a distributor assembly which can be easily assembled and reliable.

A further object of the present invention is to provide a distributor assembly which is simple in structure and in expensive.

With the above objects in view, the distributor assembly for an internal combustion engine of the present invention comprises a base, a resin molded ignition coil mounted to the base and having a side surface and a rotary shaft rotatably supported by the base for rotation in synchronization with the rotation of an internal combustion engine. The rotary shaft extends through the ignition coil and has mounted a distributor rotor on an extended end thereof. The distributor assembly further comprises a resin molded control unit disposed on the ignition coil and electrically connected thereto for controlling a primary current to the ignition coil, the control unit having a side surface. The side surfaces of the resin molded ignition coil and the resin molded control unit are exposed to the exterior of the distributor when in assembly for constituting outer surfaces of the distributor.

The distributor assembly may further comprise a cap having a center electrode and circumferential electrodes and for covering the distributor rotor, a cover for covering the control unit, and a screw extending through the cap, the cover and the control unit into threaded engagement with the base. The resin-molded ignition coil may comprise an external-connection connector integrally formed on the exposed side surface.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

FIGS. 1 to 4 illustrate one embodiment of the distributor assembly of the present invention. The distributor assembly comprises a base 20 made of a metal and adapted to be securely mounted to an internal combustion engine (not shown). The base 20 is a substantially disc-shaped member having a bearing 20*c* for rotatably supporting a rotary shaft 5 which is adapted at one end 5*a* to be operably connected to and rotate in synchronization with an engine crankshaft (not shown). The disc-shaped base plate 20 has a first substantially planar top surface 20*a*, and vertically extending support posts 20*b* having a threaded hole 20*d* for receiving a screw 32 therein for the purpose which will become apparent later.

Figure 4:
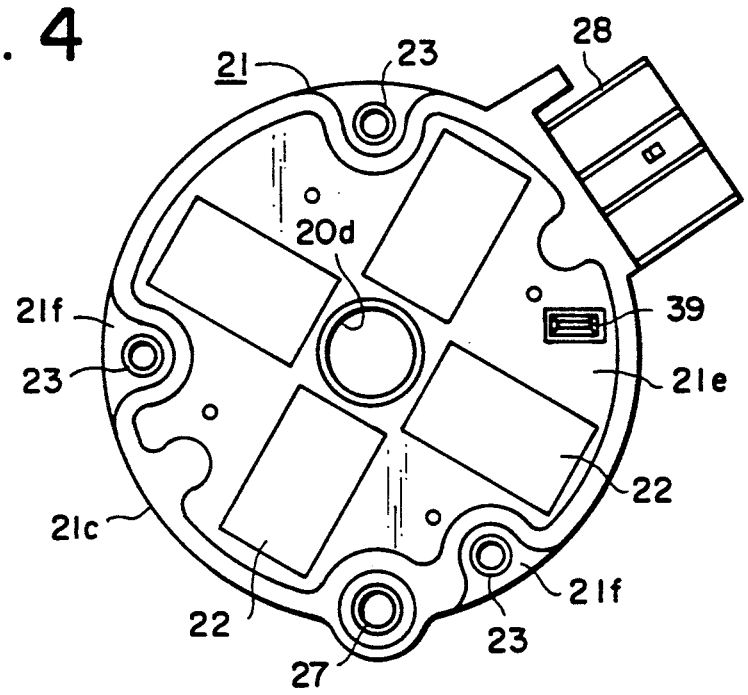
FIG. 4 is a plan view of the ignition coil of the distributor assembly illustrated in FIG. 1.

Disposed on the top surface 20*a* of the base 20 is a relatively thick, substantially disc-shaped resin-molded ignition coil unit 21. As also illustrated in FIG. 4, the resin-molded ignition coil unit 21 has a bottom surface 21*a*, a top surface 21*b* and a substantially cylindrical side surface 21*c*. The ignition coil unit 21 has a central bore 21*d* through which the rotary shaft 5 extends. Although not illustrated in detail, the ignition coil unit 21 comprises a plurality of iron cores 22 (FIG. 4), coils (not shown) wound around the iron cores 22, and a resin filler material 21*e* molded around the coils. The ignition coil unit 21 also has mounting brackets 21*f* having formed therein through holes having bushings 23. A mounting screw 24 extends through each bushing 23 to thread-engage with the base plate 20 so that the ignition coil unit 21 is securely mounted to the base plate 20. The top surface 20*a* of the base plate 20 and the bottom surface 21*a* of the ignition coil unit 21 which abut against each other may preferably be machine finished into planar surfaces. This arrangement allows the ignition coil unit 21 and the base plate 20 to have precision axial dimensions and a good thermal conductivity at the contact surface between them. It is also seen that the bottom wall 21*a* of the resin-molded ignition coil unit 21 has formed therein a raised portion 25 which, together with a stepped portion 26 formed in the top surface 20*a* of the base plate 20, constitutes a spigot joint between the base 20 and the ignition coil unit 21 for easy assembly and precise positioning.

Figure 7:
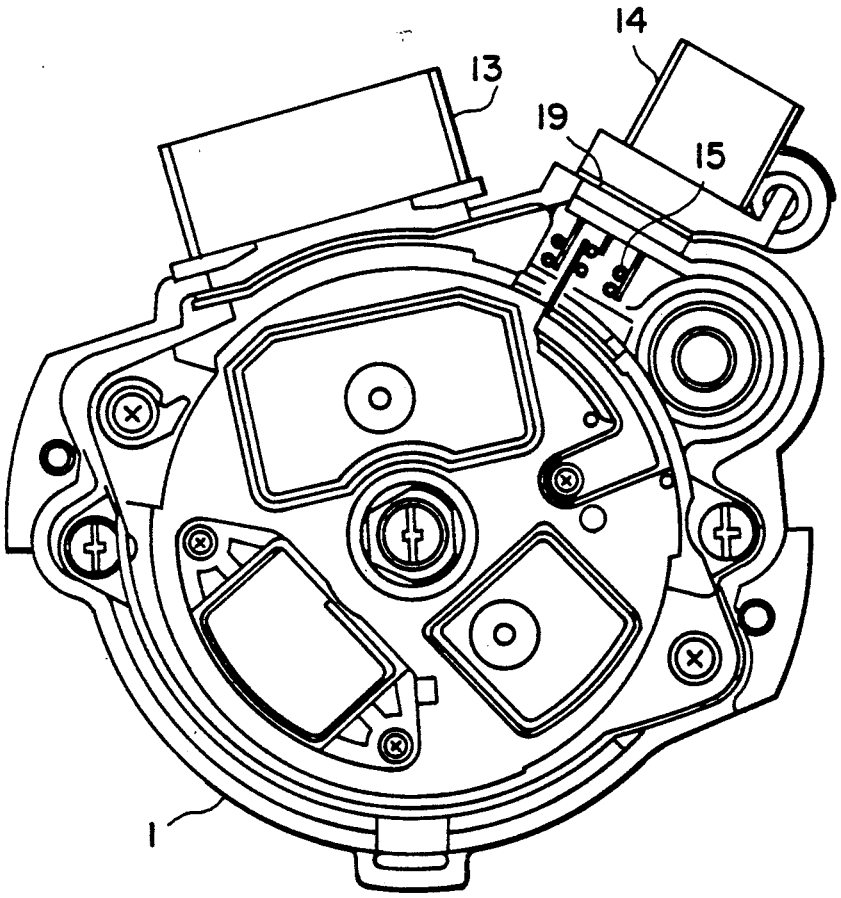
FIG. 7 is a plan view of the conventional distributor assembly illustrated in FIG. 6 but with the cap, cover and the rotor removed for clarity.

The ignition coil 21 further comprises a connector terminal 27 extending perpendicularly to the top surface 21*b* of the ignition coil unit 21 for electrical connection to the central electrode 18 of the distributor cap 2*a* which will be described later in more detail. As best seen from FIG. 4, the ignition coil unit 21 is provided with a source connector 28 radially extending from the cylindrical side surface 21*c* of the ignition coil unit 21. Since the source connector 28 has an outer case made of a molded resin, it can be integrally manufactured at the time when the main body of the ignition coil unit 21 is molded. In this context, this source connector 28 is integral with the resin-molded ignition coil unit 21 as opposed to an assembled, separate connector used in the conventional distributor assembly such as the connectors 13 and 14 illustrated in FIG. 7. The ignition coil unit 21 also comprises a male ignition coil terminal 39 which will become apparent later.

Figure 3:
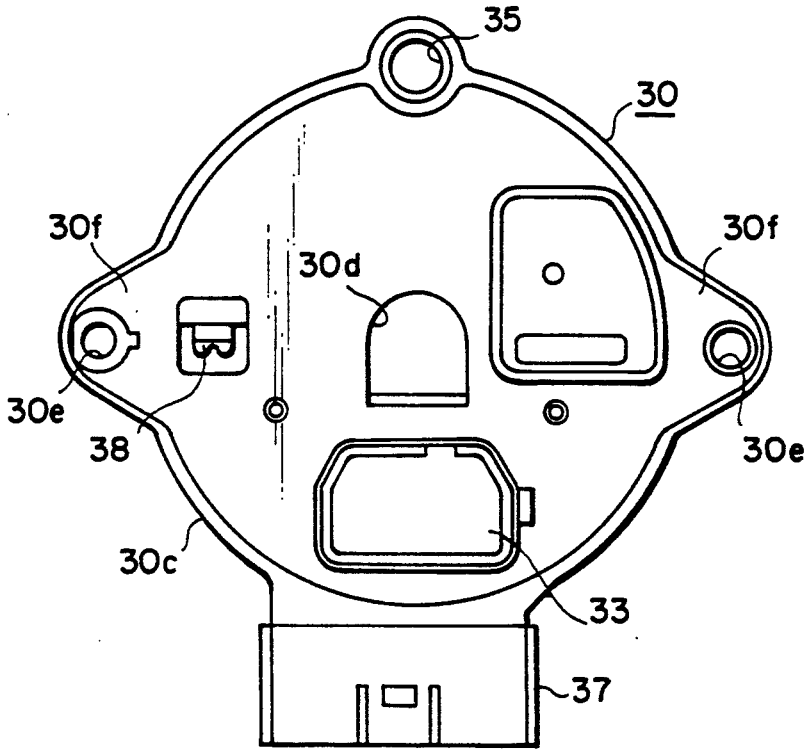
FIG. 3 is a plan view of the control unit of the distributor assembly illustrated in FIG. 1.

The distributor assembly also comprises a resin molded control unit 30 disposed on the ignition coil unit 21 for controlling a primary current to the ignition coil 21. The control unit 30 is also a substantially disc-shaped member as illustrated in FIG. 3 and having a top surface 30*a*, a bottom surface 30*b* and a substantially cylindrical circumferential side surface 30*c*. The control unit 30 has a central bore 30*d* for allowing the rotary shaft 5 to extend therethrough, a circular through hole 35 for allowing the connection terminal 27 of the ignition coil unit 21 to extend therethrough, through holes 30*e* formed in the flange 30*f* for receiving the mounting screw 32 and a female ignition coil terminal 38 connectable to the male terminal 39 on the ignition coil unit 21 and constituting a plug-in type connector between the coil unit 21 and the control unit 30. Between the top surface 21*b* of the ignition coil unit 21 and the bottom surface 30*b*, a seal 34 is disposed for preventing ingress of dust and moisture. Since these surfaces 21*b* and 30*b* are substantially planar surfaces, the seal 34 therebetween can be a planar seal in the form of a sheet which is simple and reliable.

Figure 6:
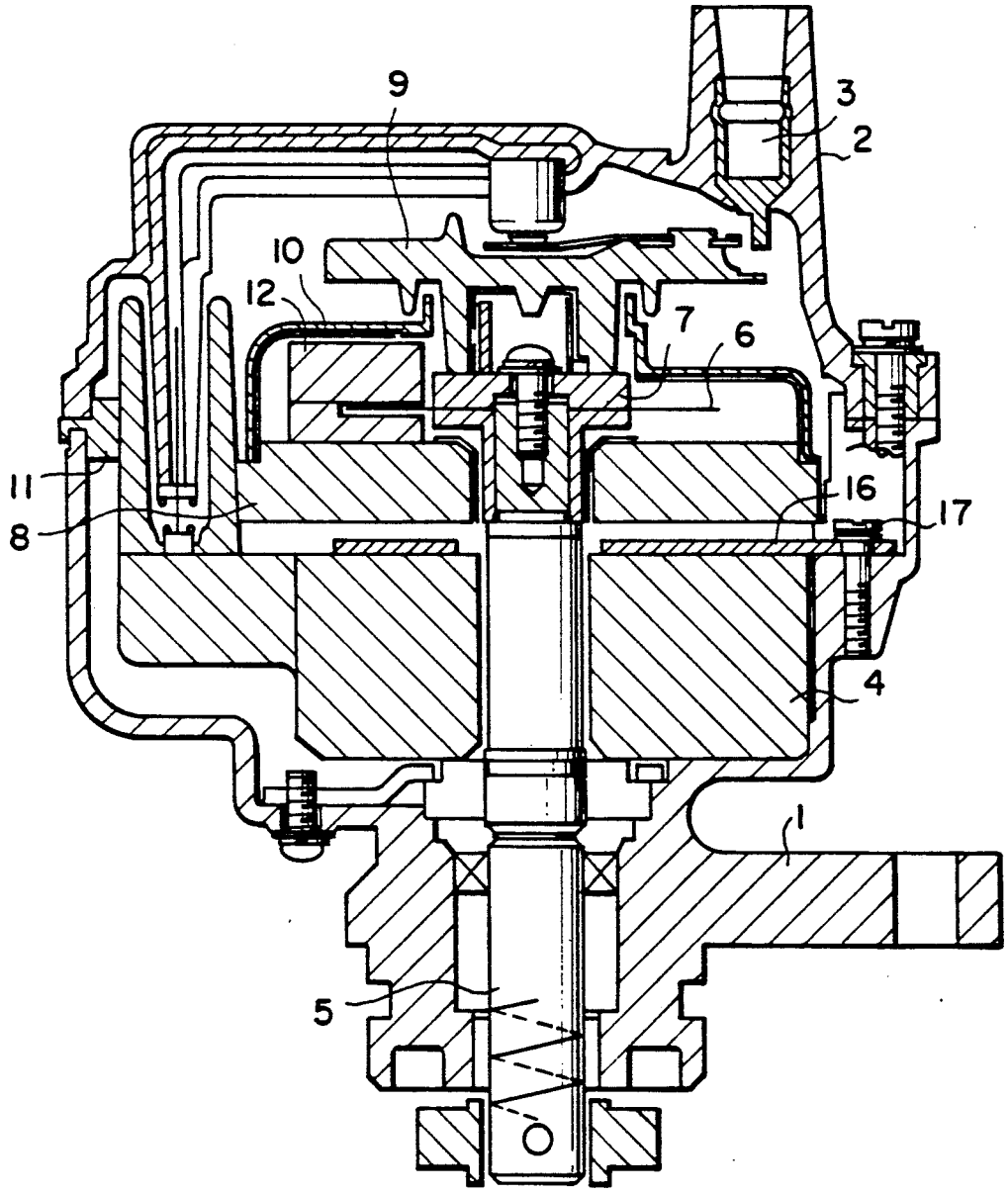
FIG. 6 is a sectional side view of a conventional distributor assembly.

The control unit 30 also comprises a crankshaft rotational angle sensor 33 which operates in cooperation with the perforated signal disc plate 6 mounted to the top end of the rotary shaft 5 by means of the blank 7. The crankshaft rotational angle sensor 33 generates a signal indicative of rotational position and/or speed of the engine crankshaft (not shown) as is well-known in the art. It is seen that the signal disc plate 6 and the crankshaft rotational angle sensor 33 are covered by a protective cover 10 similar to that illustrated in FIG. 6.

Securely mounted to the top of the blank 7 is a distributor rotor 9 for distributing the high-tension secondary voltage supplied from the ignition coil unit 21. The rotor 9 and other components are covered by a cap 2*a* illustrated in FIG. 2 attached to the control unit 30 by means of mounting brackets 2*b* having a through hole 2*c* for receiving the mounting screw 32 therein. As best seen from FIG. 1, the cap 2*a* comprises an electrical conductor 18*a* having at one end thereof a socket 18*b* connected to the ignition terminal 27 and at the other end thereof the center electrode 18 and a plurality of circumferential electrodes 3. As is well known in the art, the high-tension voltage from the ignition coil unit 21 is sequentially supplied to the circumferential electrodes 3 through the terminal 27, the conductor 18*a*, the center electrode 18 and the rotor 9 as it is rotated by the rotary shaft 5.

Figure 1:
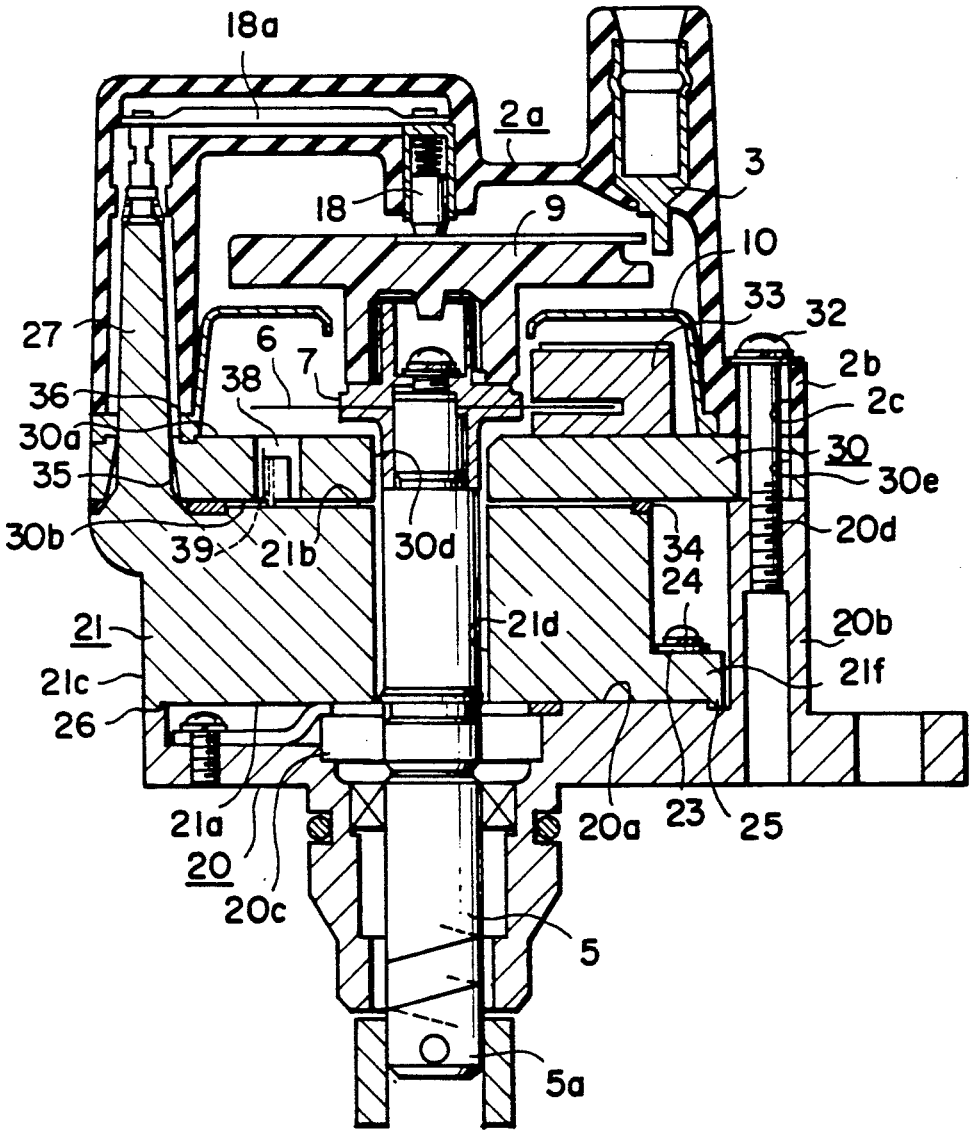
FIG. 1 is a sectional side view of a distributor assembly for an internal combustion engine of one embodiment of the present invention.
Figure 2:
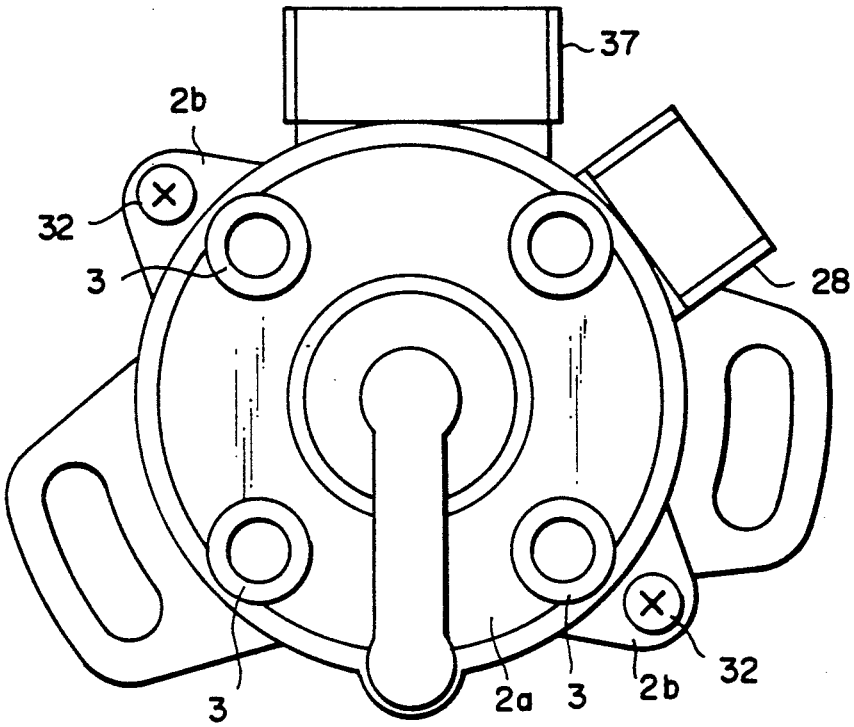
FIG. 2 is a plan view of the distributor assembly illustrated in FIG. 1.

As seen from FIG. 1, the mounting bolts 32 extends through the through holes 2*c* of the bracket 2*b* of the cap 2*a* and the through holes 30*e* of the bracket 30*f* of the control unit 30 and thread-engaged with the threaded hole 20*d* of the support posts 20*b* of the base 20, whereby the cap 2*a*, the control unit 30, the ignition coil unit 21 which is secured to the base 20 by the screws 23 and the base plate 20 are firmly connected together in a stacked, unitary structure. It is to be noted that since there is no enclosure member corresponding to the housing 1 illustrated in FIGS. 6 and 7, the outer surface of the ignition coil unit is defined at least partially by the exposed substantially cylindrical side surfaces 21*c* and 30*c* of the resin-molded ignition coil unit 21 and the resin-molded control unit 30, respectively.

Figure 5:
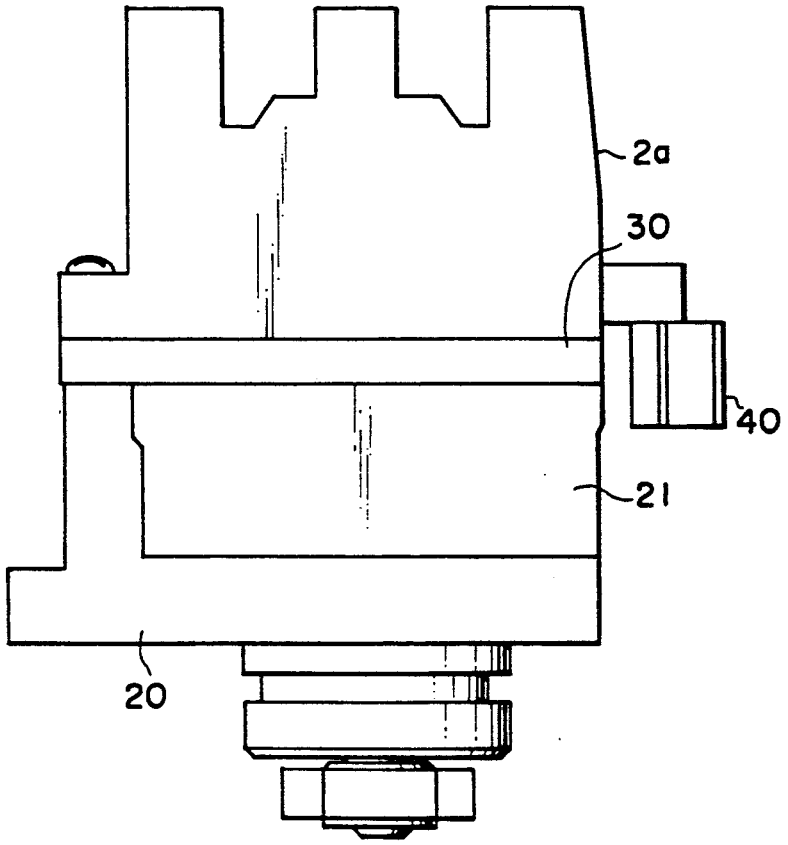
FIG. 5 is a side view of another embodiment of the distributor assembly of the present invention.

FIG. 5 illustrates another embodiment of the ignition coil unit of the present invention which comprises a substantially L-shaped external connector 40 having an axial access direction for connecting an external circuit to the control unit 30. The external connector 40 is integrally formed with and radially projected from the resin-molded control unit 30 and bent in the axial direction so that the direction of insertion and removal of the mating plug is in the axial direction. Therefore, the radial dimension of the ignition coil unit including the connector 40 and the mating plug of another equipment can be reduced as compared to the conventional design in which the connector radially extends from the ignition coil unit and must be accessed in the radial direction.

What is claimed is

1. A distributor for an internal combustion engine comprising:

a base;

a resin-molded ignition coil unit mounted to said base and having a side surface;

a rotary shaft rotatably supported by said base for rotation in synchronization with the rotation of an internal combustion engine, said rotary shaft extending through said ignition coil unit and having a distributor rotor on an extended end thereof; and a resin-molded control unit disposed on said ignition coil unit and electrically connected thereto for controlling a primary current to said ignition coil unit, said control unit having a side surface;

said side surfaces of said resin-molded ignition coil unit and said resin-molded control unit are exposed to the exterior of the distributor when in assembly for constituting outer surfaces of the distributor.

2. A distributor as claimed in claim 1, further comprising a cap having a center electrode and circumferential electrodes and for covering said distributor rotor, a cover for covering said control unit, and a screw extending through said cap, said cover and said control unit into threaded engagement with said base.

3. A distributor as claimed in claim 1, wherein said resin-molded ignition coil unit comprises an external-connection connector integrally formed on said exposed side surface.

4. A distributor as claimed in claim 3, wherein said external connector comprises a substantially L-shaped connector having an axial access direction.

5. A distributor as claimed in claim 1, wherein said base and said resin-molded ignition coil unit comprise a spigot joint for engagement therebetween.

6. A distributor as claimed in claim 1, wherein said ignition coil and said control unit comprise a plug-in type connector.

7. A distributor as claimed in claim 1, wherein said ignition coil unit is attached to said base through a screw extending through a bushing disposed on said ignition coil.

8. A distributor as claimed in claim 1, wherein said control unit has therein a through hole for allowing an electrical conductor from said ignition coil unit to extend therethrough, and said control unit and said ignition coil unit have substantially planar surfaces therebetween, said distributor further comprising a planar packing disposed between said planar surfaces.

9. A distributor as claimed in claim 1, wherein said base and said ignition coil unit have precision-machined planar abutting surfaces therebetween.

* * * * *